US007007479B2

(12) United States Patent
Held et al.

(10) Patent No.: US 7,007,479 B2
(45) Date of Patent: Mar. 7, 2006

(54) METHOD AND APPARATUS TO DECREASE COMBUSTOR EMISSIONS

(75) Inventors: Timothy James Held, Blanchester, OH (US); Mark Anthony Mueller, West Chester, OH (US); Jun Xu, Mason, OH (US)

(73) Assignee: General Electric Company, Schenecady, NY (US)

( * ) Notice: Subject to any disclaimer, the term of this patent is extended or adjusted under 35 U.S.C. 154(b) by 7 days.

(21) Appl. No.: 10/929,909

(22) Filed: Aug. 30, 2004

(65) Prior Publication Data

US 2005/0103021 A1 May 19, 2005

Related U.S. Application Data

(62) Division of application No. 10/308,502, filed on Dec. 3, 2002, now Pat. No. 6,862,889.

(51) Int. Cl.
*F23R 3/14* (2006.01)

(52) U.S. Cl. ..... 60/747; 60/748

(58) Field of Classification Search ..... 60/737, 60/746, 747, 748; 431/354
See application file for complete search history.

(56) References Cited

U.S. PATENT DOCUMENTS 6,389,815 B1 * 5/2002 Hura et al. ..... 60/748
6,418,726 B1 * 7/2002 Foust et al. ..... 60/748
6,427,435 B1 * 8/2002 Patterson et al. ..... 60/748
6,718,770 B1 * 4/2004 Laing et al. ..... 60/747

* cited by examiner

*Primary Examiner*—Louis J. Casaregola
(74) *Attorney, Agent, or Firm*—William Scott Andes; Armstrong Teasdale LLP

(57) ABSTRACT

A method for operating a gas turbine engine facilitates reducing an amount of emissions from a combustor. The combustor includes a mixer assembly including a pilot mixer, a main mixer, and an annular centerbody extending therebetween. The method comprises injecting at least one of fuel and airflow into the combustor through at least one swirler positioned within the pilot mixer, and injecting fuel into the combustor through at least one swirler positioned within the main mixer, such that the fuel is directed into a combustion chamber downstream from the main mixer.

6 Claims, 3 Drawing Sheets

METHOD AND APPARATUS TO DECREASE COMBUSTOR EMISSIONS

CROSS-REFERENCE TO RELATED APPLICATIONS

This application is a divisional of U.S. patent application Ser. No. 10/308,502, filed Dec. 3, 2002 now U.S. Pat. No. 6,862,889 which is hereby incorporated by reference and is assigned to assignee of the present invention.

BACKGROUND OF THE INVENTION

This application relates generally to combustors and, more particularly, to gas turbine combustors.

Air pollution concerns worldwide have led to stricter emissions standards both domestically and internationally. Pollutant emissions from industrial gas turbines are subject to Environmental Protection Agency (EPA) standards that regulate the emission of oxides of nitrogen (NOx), unburned hydrocarbons (HC), and carbon monoxide (CO). In general, engine emissions fall into two classes: those formed because of high flame temperatures (NOx), and those formed because of low flame temperatures that do not allow the fuel-air reaction to proceed to completion (HC & CO).

At least some known gas turbine combustors include between 10 and 30 mixers, which mix high velocity air with liquid fuels such as diesel fuel, and/or gaseous fuels such as natural gas. These mixers usually consist of a single fuel injector located at a center of a swirler for swirling the incoming air to enhance flame stabilization and mixing. Both the fuel injector and mixer are located on a combustor dome.

For most aeroderivative gas turbine engines, the fuel to air ratio in the mixer is rich. Since the overall combustor fuel-air ratio of gas turbine combustors is lean, additional air is added through discrete dilution holes prior to exiting the combustor. Poor mixing and hot spots can occur both at the dome, where the injected fuel must vaporize and mix prior to burning, and in the vicinity of the dilution holes, where air is added to the rich dome mixture. Other aeroderivative engines employ dry-low-emissions (DLE) combustors that create fuel-lean mixtures. Because the fuel-air mixture throughout the combustor is fuel-lean, DLE combustors typically do not have dilution holes.

One state-of-the-art lean dome combustor is referred to as a dual annular combustor (DAC) because it includes two radially stacked mixers on each fuel nozzle which appear as two annular rings when viewed from the front of a combustor. The additional row of mixers allows tuning for operation at different conditions. At idle, the outer mixer is fueled, which is designed to operate efficiently at idle conditions. At high power operation, both mixers are fueled with the majority of fuel and air supplied to the inner annulus, which is designed to operate most efficiently and with few emissions at high power operation. While the mixers have been tuned for optimal operation with each dome, the boundary between the domes quenches the CO reaction over a large region, which makes the CO emissions of these designs higher than similar rich dome single annular combustors (SACs). Such a combustor is a compromise between low power emissions and high power NOx.

Other known combustors operate as a lean dome combustor. Instead of separating the pilot and main stages in separate domes and creating a significant CO quench zone at the interface, the mixer incorporates concentric, but distinct pilot and main air streams within the device. However, the simultaneous control of low power CO/HC and smoke emissions is difficult with such designs because increasing the fuel/air mixing often results in high CO/HC emissions. The swirling main air naturally tends to entrain the pilot flame and quench it.

BRIEF SUMMARY OF THE INVENTION

In one aspect, a method for operating a gas turbine engine to facilitate reducing an amount of emissions from a combustor is provided. The combustor includes a mixer assembly including a pilot mixer, a main mixer, and an annular centerbody extending therebetween. The method comprises injecting fuel into the combustor through at least one swirler vane within the pilot mixer, and at least one swirler vane positioned within the main mixer.

In another aspect of the invention, a combustor for a gas turbine is provided. The combustor is comprised of a combustion chamber and fuel-air premixers with pilot and main circuits that are separated by annular centerbodies. The pilot mixer includes a pilot centerbody and at least one axial air swirler that is radially outward from and concentrically mounted with respect to the pilot centerbody. The main mixer is radially outward from and concentrically aligned with respect to the pilot mixer. The main mixer includes swirler vanes that are configured to inject fuel into the main mixer. Both the main and pilot mixers are located upstream of the combustion chamber. The annular centerbody extends between the pilot mixer and the main mixer. The centerbody includes a radially inner surface and a radially outer surface. The radially inner surface includes convergent and divergent portions.

In a further aspect, a gas turbine engine is comprised of a combustor that is comprised of a combustion chamber and at least one fuel-air mixer assembly. The mixer assembly is for controlling emissions from the combustor, and includes pilot and main circuits that are separated by annular centerbodies. The pilot mixer includes a pilot centerbody and at least one swirler that is radially outward from the pilot centerbody. The main mixer is radially outward from and concentrically aligned with respect to the pilot mixer. The main mixer includes at least one swirler vane that is configured to inject fuel therethrough into the main mixer. The main and pilot mixers are both located upstream from the combustion chamber.

DETAILED DESCRIPTION OF THE INVENTION

Figure 1:
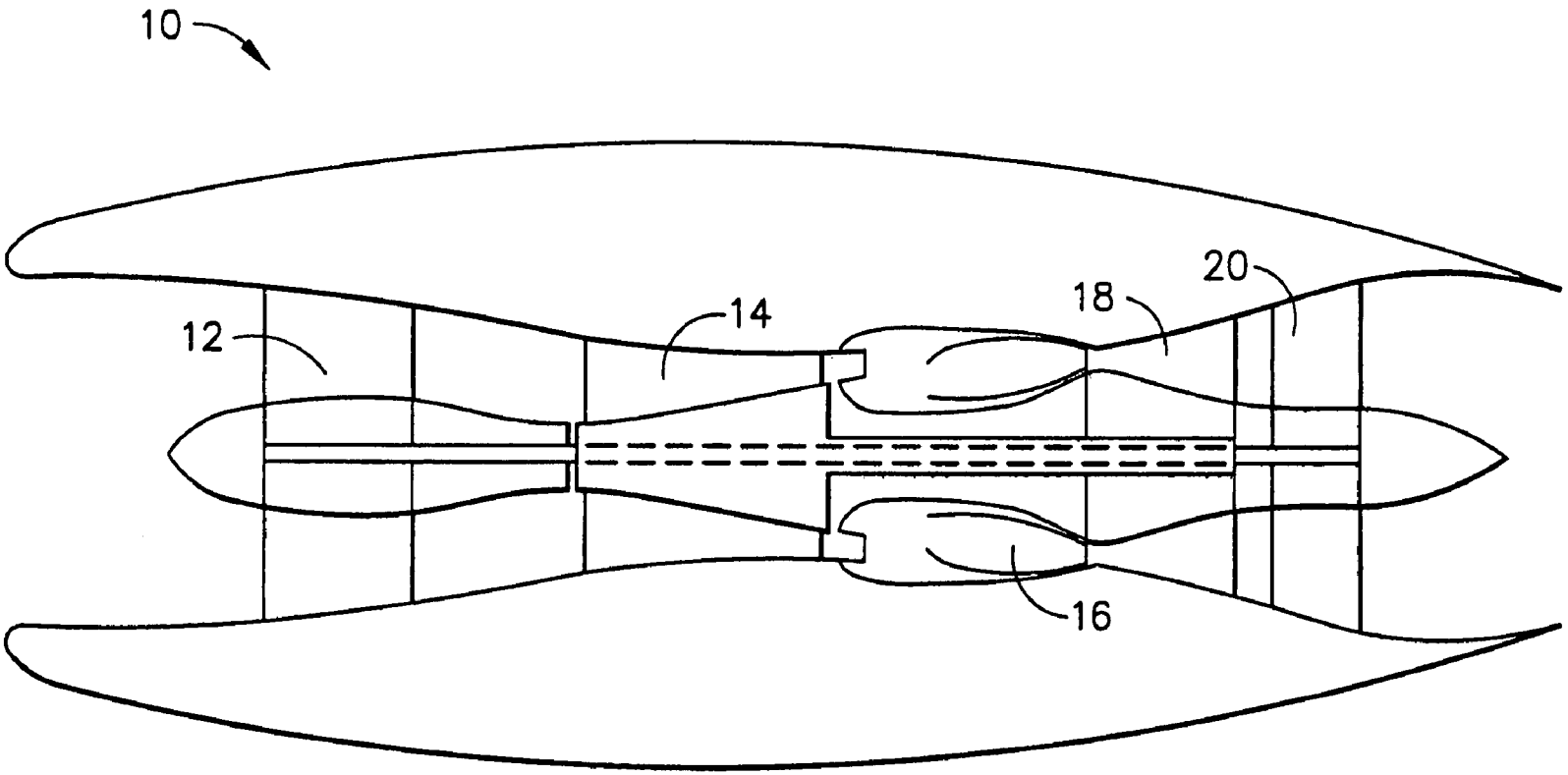
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20. In one embodiment, gas turbine engine 10 is a CFM engine available from CFM International. In another embodiment, gas turbine engine 10 is a GE90engine available from General Electric Company, Cincinnati, Ohio.

Figure 2:
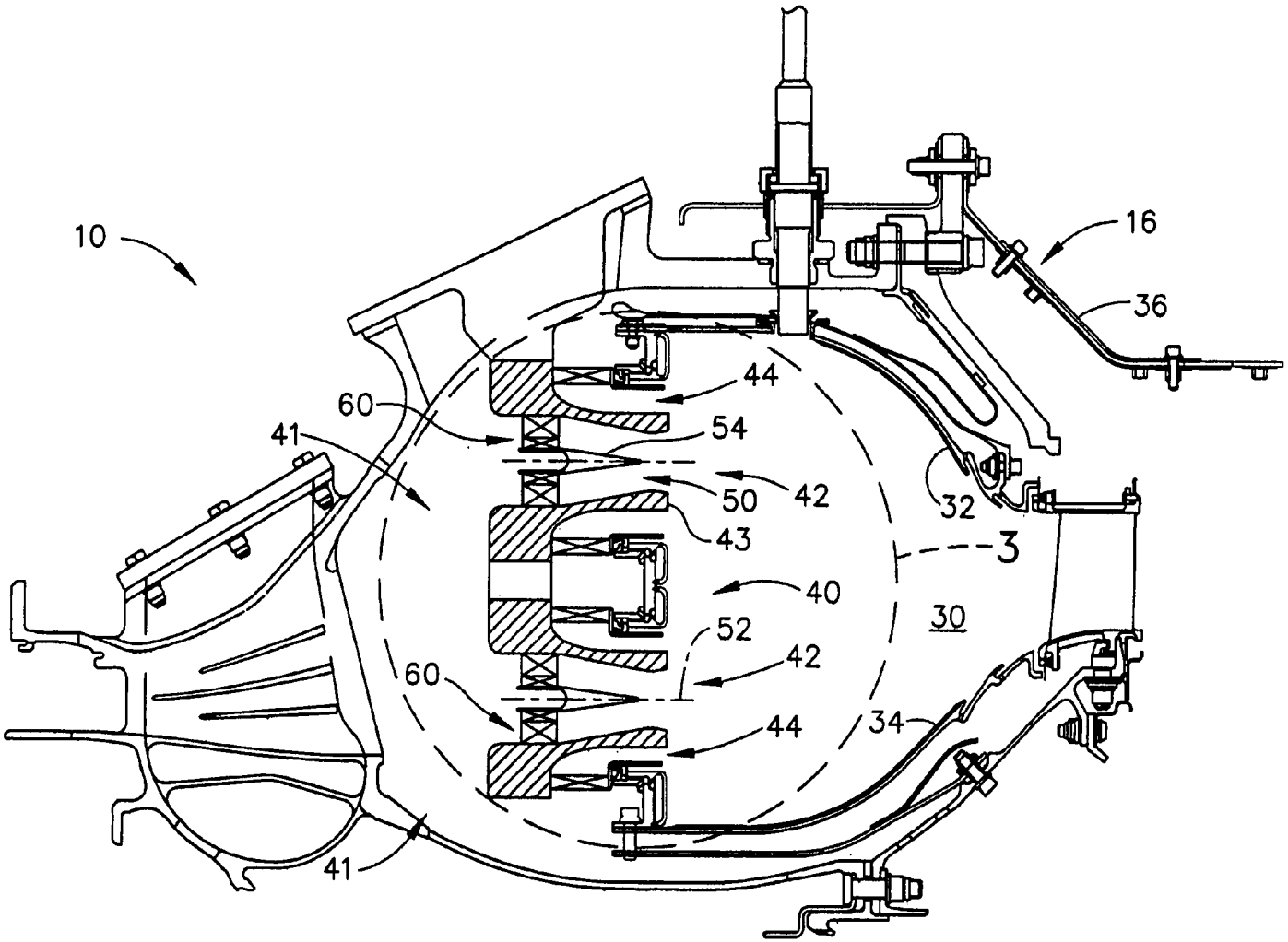
FIG. 2 is a cross-sectional view of a combustor that may be used with the gas turbine engine shown in FIG. 1.
Figure 3:
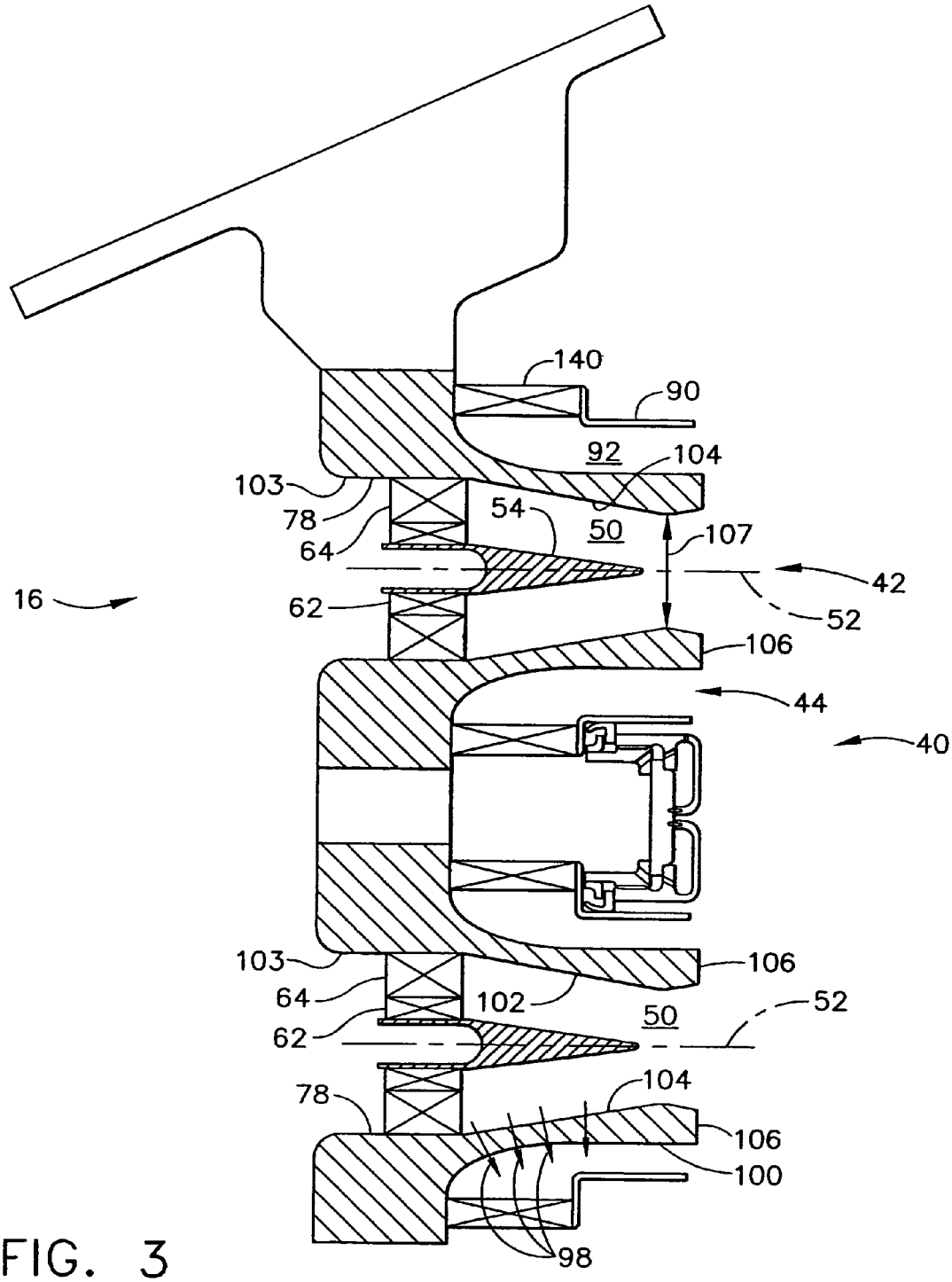
FIG. 3 is an enlarged view of a portion of the combustor shown in FIG. 2 taken along area 3.

FIG. 2 is a cross-sectional view of combustor 16 for use with a gas turbine engine, similar to engine 10 shown in FIG. 1, and FIG. 3 is an enlarged partial view of combustor 16 taken along area 3. Combustor 16 includes a combustion zone or chamber 30 defined by annular, radially outer and radially inner liners 32 and 34. More specifically, outer liner 32 defines an outer boundary of combustion chamber 30, and inner liner 34 defines an inner boundary of combustion chamber 30. Liners 32 and 34 are radially inward from an annular combustor casing 36, which extends circumferentially around liners 32 and 34.

Combustor 16 also includes an annular dome 40 mounted upstream from outer and inner liners 32 and 34, respectively. Dome 40 defines an upstream end of combustion chamber 30 and mixer assemblies 41 are spaced circumferentially around dome 40 to deliver a mixture of fuel and air to combustion chamber 30. Because combustor 16 includes two annular domes 40, combustor 16 is known as a dual annular combustor (DAC). Alternatively, combustor 16 may be a single annular combustor (SAC) or a triple annular combustor.

Each mixer assembly 41 includes a pilot mixer 42, a main mixer 44, and an annular centerbody 43 extending therebetween. Centerbody 43 defines a chamber 50 that is in flow communication with, and downstream from, pilot mixer 42. Chamber 50 has an axis of symmetry 52, and is generally cylindrical-shaped. A pilot centerbody 54 extends into chamber 50 and is mounted symmetrically with respect to axis of symmetry 52.

Pilot mixer 42 also includes a pair of concentrically mounted swirlers 60. More specifically, in the exemplary embodiment, swirlers 60 are axial swirlers and include a pilot inner swirler 62 and a pilot outer swirler 64. Pilot inner swirler 62 is annular and is circumferentially disposed around pilot centerbody 54. Each swirler 62 and 64 includes a plurality of vanes (not shown). Swirler 64 includes a plurality of orifices (not shown) along walls 104 and 106 for the injection of gaseous fuel. More specifically, orifices are located along a trailing edge of swirler 64 inject fuel downstream into chamber 50. Additionally, orifices located along wall 104 inject fuel radially inward both upstream and downstream of a venturi throat 107. Swirlers 62 and 64 are designed to provide desired ignition characteristics, lean stability, and low carbon monoxide (CO) and hydrocarbon (HC) emissions during low engine power operations. In one embodiment, a pilot splitter (not shown) is positioned radially between pilot inner swirler 62 and pilot outer swirler 64, and extends downstream from pilot inner swirler 62 and pilot outer swirler 64.

Pilot outer swirler 64 is radially outward from pilot inner swirler 62, and radially inward from a radially inner passageway surface 78 of centerbody 43. More specifically, pilot outer swirler 64 extends circumferentially around pilot inner swirler 62 and is radially between pilot inner swirler 62 and centerbody 43. In one embodiment, pilot swirler 62 swirls air flowing therethrough in the same direction as air flowing through pilot swirler 64. In another embodiment, pilot inner swirler 62 swirls air flowing therethrough in a first direction that is opposite a second direction that pilot outer swirler 64 swirls air flowing therethrough.

Main mixer 44 includes an annular main housing 90 that defines an annular cavity 92. Main mixer 44 is concentrically aligned with respect to pilot mixer 42 and extends circumferentially around pilot mixer 42. Annular centerbody 43 extends between pilot mixer 42 and main mixer 44 and defines a portion of main mixer cavity 92.

Annular centerbody 43 includes a plurality of injection ports 98 mounted to a radially outer surface 100 of centerbody 43 for injecting fuel radially outwardly from centerbody 43 into main mixer cavity 92. Fuel injection ports 98 facilitate circumferential fuel-air mixing within main mixer 44.

In one embodiment, centerbody 43 includes a pair of rows of circumferentially-spaced injection ports 98. In another embodiment, centerbody 43 includes a plurality of injection ports 98 that are not arranged in circumferentially-spaced rows. The location of injection ports 98 is selected to adjust a degree of fuel-air mixing to achieve low nitrous oxide (NOx) emissions and to insure complete combustion under variable engine operating conditions. Furthermore, the injection port location is also selected to facilitate reducing or preventing combustion instability.

Centerbody 43 separates pilot mixer 42 and main mixer 44. Accordingly, pilot mixer 42 is sheltered from main mixer 44 during pilot operation to facilitate improving pilot performance stability and efficiency, while also reducing CO and HC emissions. Furthermore, centerbody 43 is shaped to facilitate completing a burnout of pilot fuel injected into combustor 16. More specifically, an inner passage wall 102 of centerbody 43 includes an entrance portion 103, a converging-diverging surface 104, and an aft shield 106.

Converging-diverging surface 104 extends from entrance portion 103 to aft shield 106, and defines a venturi throat 107 within pilot mixer 42. Aft shield 106 extends between surface 104 and outer surface 100.

Main mixer 44 also includes a swirler 140 located upstream from centerbody fuel injection ports 98. First swirler 140 is a radial inflow cyclone swirler and fluidflow therefrom is discharged radially inwardly towards axis of symmetry 52. In an alternative embodiment, swirler 140 is a conical swirler. More specifically, swirler 140 is coupled in flow communication to a fuel source (not shown) and is thus configured to inject fuel therethrough, which facilitates improving fuel-air mixing of fuel injected radially inwardly from swirler 140 and radially outwardly from injection ports 98. In an alternative embodiment, first swirler 140 is split into pairs of swirling vanes (not shown) that may be co-rotational or counter-rotational.

A fuel delivery system supplies fuel to combustor 16 and includes a pilot fuel circuit and a main fuel circuit. The pilot fuel circuit supplies fuel to pilot mixer 42 and the main fuel circuit supplies fuel to main mixer 44 and includes a plurality of independent fuel stages used to control nitrous oxide emissions generated within combustor 16.

In operation, as gas turbine engine 10 is started and operated at idle operating conditions, fuel and air are supplied to combustor 16. During gas turbine idle operating conditions, combustor 16 uses only pilot mixer 42 for operating. The pilot fuel circuit injects fuel to combustor 16 through pilot outer swirler 64 and/or through walls 104 and 106. Simultaneously, airflow enters pilot swirlers 60 and main mixer swirler 140. The pilot airflow flows substantially parallel to center mixer axis of symmetry 52. More specifically, the airflow is directed into a pilot flame zone downstream from pilot mixer 42. The pilot flame becomes anchored adjacent to, and downstream from venturi throat 107, and is sheltered from main airflow discharged through main mixer 44 by annular centerbody 43.

As engine 10 is increased in power from idle to part-power operations, fuel flow to pilot mixer 42 is increased. In this mode of operation, products from the pilot flame mix with airflow discharged through main mixer swirler 140, and are further oxidized prior to exiting combustion chamber 30.

The transition from pilot-only, part-power mode to a higher-power operating mode, in which fuel flow is supplied to pilot mixer 42 and main mixer 44, occurs when the fuel flow rate is sufficient to support complete combustion in both mixers 42 and 44. More specifically, as gas turbine engine 10 is accelerated from idle operating conditions to increased power operating conditions, additional fuel and air are directed into combustor 16. In addition to the pilot fuel stage, during increased power operating conditions, main mixer 44 is supplied fuel through swirler 140 and is injected radially outward from fuel injection ports 98. Main mixer swirler 140 facilitates radial and circumferential fuel-air mixing to provide a substantially uniform fuel and air distribution for combustion. Uniformly distributing the fuel-air mixture facilitates obtaining a complete combustion to reduce high power operation $NO_x$ emissions.

In addition, because pilot mixer 42 serves as an ignition source for fuel discharged into main mixer 44, pilot mixer 42 and annular centerbody 43 facilitate main mixer 44 operating at reduced flame temperatures. At maximum power, the fuel flow split between pilot mixer 42 and main mixer 44 is determined by emissions, operability, and combustion acoustics.

The above-described combustor is cost-effective and highly reliable. The combustor includes a mixer assembly that includes a pilot mixer, a main mixer, and a centerbody. The pilot mixer is used during lower power operations and the main mixer is used during mid and high power operations. During idle power operating conditions, the combustor operates with low emissions and has only air supplied to the main mixer. During increased power operating conditions, the combustor also supplies fuel to the main mixer which through a swirler to improve main mixer fuel-air mixing. The lower operating temperatures and improved combustion facilitate increased operating efficiencies and decreased combustor emissions at high power operations. As a result, the combustor operates with a high combustion efficiency and low carbon monoxide, nitrous oxide, and smoke emissions.

Exemplary embodiments of combustor assemblies are described above in detail. The systems are not limited to the specific embodiments described herein, but rather, components of each assembly may be utilized independently and separately from other components described herein. Each combustor assembly component can also be used in combination with other combustor assembly components.

While the invention has been described in terms of various specific embodiments, those skilled in the art will recognize that the invention can be practiced with modification within the spirit and scope of the claims.

What is claimed is:

1. A gas turbine engine comprising a combustor comprising a combustion chamber and a mixer assembly upstream from said combustion chamber for controlling emissions from said combustor, said mixer assembly comprising a pilot mixer and a main mixer, said pilot mixer comprising a pilot centerbody and a plurality of swirlers upstream and radially outward from said pilot centerbody, said main mixer radially outward from and concentrically aligned with respect to said pilot mixer, said main mixer comprising at least one swirler configured to inject fuel therethrough towards said combustion chamber, said combustor further comprises an annular centerbody extending between said pilot mixer and said main mixer, said centerbody comprising a radially inner surface, a radially outer surface, and a plurality of fuel injection ports, said radially inner surface comprising a divergent portion and a convergent portion, said plurality of fuel injection ports configured to inject fuel radially outwardly into said main mixer.

2. A gas turbine engine in accordance with claim 1 wherein said combustor annular centerbody radially inner surface defines a venturi throat downstream from said pilot mixer centerbody.

3. A gas turbine engine in accordance with claim 1 wherein said combustor main mixer at least one swirler comprises at least one of a conical air swirler and a cyclone air swirler.

4. A gas turbine engine in accordance with claim 1 wherein said combustor main mixer at least one swirler is positioned to direct fuel passing therethrough radially inward towards said pilot mixer.

5. A gas turbine engine in accordance with claim 1 wherein said combustor pilot mixer at least one swirler comprises a radially inner swirler and a radially outer swirler, said radially inner swirler extending between said radially outer swirler and said pilot mixer centerbody.

6. A gas turbine engine in accordance with claim 1 wherein said combustor comprises at least one of a single annular combustor, a dual annular combustor, and a triple-annular combustor.

* * * * *